US006841928B2

(12) United States Patent
Kang

(10) Patent No.: US 6,841,928 B2
(45) Date of Patent: Jan. 11, 2005

(54) BASE PANEL HAVING PARTITION AND PLASMA DISPLAY DEVICE UTILIZING THE SAME

(75) Inventor: Tae-kyoung Kang, Seoul (KR)

(73) Assignee: Samsung SDI Co., Ltd., Suwon (KR)

( * ) Notice: Subject to any disclaimer, the term of this patent is extended or adjusted under 35 U.S.C. 154(b) by 114 days.

(21) Appl. No.: 09/842,857

(22) Filed: Apr. 27, 2001

(65) Prior Publication Data

US 2002/0003405 A1 Jan. 10, 2002

(30) Foreign Application Priority Data

Apr. 29, 2000 (KR) ..... 2000-23101

(51) Int. Cl.[7] ..... H01J 1/62

(52) U.S. Cl. ..... 313/483; 313/484; 313/485; 313/491; 313/494; 313/495; 313/586; 313/587

(58) Field of Search ..... 313/483, 484, 313/485, 491, 494, 495, 496, 586, 587; 445/23, 24, 25

(56) References Cited

U.S. PATENT DOCUMENTS 5,793,158 A 8/1998 Wedding, Sr.
5,952,782 A * 9/1999 Nanto et al. ..... 313/586
5,967,872 A 10/1999 Betsui et al.
6,411,043 B1 * 6/2002 Jeong et al. ..... 313/485
6,489,722 B1 * 12/2002 Yoshida et al. ..... 313/491
2002/0021090 A1 * 2/2002 Sano et al.

FOREIGN PATENT DOCUMENTS

JP 10-144225 5/1998

* cited by examiner

*Primary Examiner*—Ashok Patel
*Assistant Examiner*—Sharlene Leurig
(74) *Attorney, Agent, or Firm*—McGuireWoods LLP

(57) ABSTRACT

A plasma display panel including a first panel, address electrodes formed on the first panel in a predetermined pattern, a first dielectric layer formed on the first panel and covering the address electrodes, a partition structure having unit partitions discontinuously formed on the first dielectric layer to partition a discharge space, the unit partitions being parallel to the address electrodes and each having auxiliary partitions, red, green and blue phosphor layers coated in the partitioned discharge space, a second panel, which is coupled to the first panel to form the discharge space and which is transparent, a plurality of pairs of sustaining electrodes formed on an inner surface of the second panel and having sets of first and second electrodes at a predetermined angle with respect to the address electrodes, and a second dielectric layer formed on the second panel and covering the sustaining electrodes.

21 Claims, 5 Drawing Sheets

BASE PANEL HAVING PARTITION AND PLASMA DISPLAY DEVICE UTILIZING THE SAME

CROSS-REFERENCE TO RELATED APPLICATIONS

This application claims the benefit of Korean Application No. 2000-23101, filed Apr. 29, 2000 in the Korean Industrial Property Office, the disclosure of which is incorporated herein by reference.

BACKGROUND OF THE INVENTION

1. Field of the Invention

The present invention relates to a plasma display device, and more particularly, to a base panel having a partition structure which can prevent cross talk between adjacent pixels, and a plasma display panel utilizing the base panel.

2. Description of the Related Art

A plasma display panel generates light by exciting phosphors or a special gas, and using the reaction to form an image from the generated light. Plasma display panels are typically classified into an alternating current (AC) type, a direct current (DC) type, or a hybrid type.

An AC plasma display device includes a base panel and a front panel. The base panel includes address electrodes formed thereon, a lower dielectric layer formed on the resultant structure having the address electrodes, and partitions, formed on the lower dielectric layer, to maintain a discharge gap and to prevent electrical and optical cross talk between cells defined between the partitions. The front panel is coupled to the base panel having the partitions, and has electrodes having a predetermined pattern, formed on its bottom surface orthogonally to the address electrodes, an upper dielectric layer covering the electrodes, and an MgO film formed on the top surface of the upper dielectric layer. A phosphor layer is formed on at least one side of a discharge space separated by the partitions.

In the plasma display device having the aforementioned configuration, as a predetermined voltage is applied to the respective electrodes of the front panel, cations are accumulated on the dielectric layer, a preliminary discharge occurs between one of the respective electrodes and the address electrodes to form charged particles, and a main discharge occurs between each of the respective electrodes formed on the front panel. Then, the phosphor layer is excited by ultraviolet (UV) rays generated during the main discharge to form an image.

In the plasma display device operating in the above-described manner, the partition that partitions the discharge space has a variety of shapes. A rib or barrier structure that is striped is conventionally known. In the striped barrier structure, since only three surfaces, that is, the bottom surface and sidewalls of barriers, are coated with the phosphor layer, the luminescence efficiency is relatively low.

Another conventional structure employs a waffled barrier structure. Since the barriers surround every surface of a discharge space, it is difficult to either exhaust gas from the discharge space partitioned by the barriers or to inject discharge gas into the discharge space during the manufacture of the plasma display device.

In the case of the waffled barrier, in order to facilitate exhaustion, protrusions are formed on top of the barrier using a dielectric material to maintain a gap between the barrier and front substrate. However, the protrusion forming step is a separate process, and charges move through the gap formed between the barrier and the front substrate, which may cause a discharge error.

Another known solution is to use separator walls having a zig-zag, snaking, meandering structure. This structure forms channels having relatively wide discharge cells and narrow connecting parts. While these separator walls widen the discharge space to some extent, they cannot fundamentally solve the problem of cross talk between adjacent pixels.

SUMMARY OF THE INVENTION

To solve the above and other problems, it is an object of the present invention to provide a base panel having a partition structure which can exhibit an improved level of luminance by increasing the coating area of a phosphor layer and which can improve the exhaustion efficiency of exhaust gas, and a plasma display device utilizing the base panel.

Additional objects and advantages of the invention will be set forth in part in the description which follows and, in part, will be obvious from the description, or may be learned by practice of the invention.

To achieve the above and other objects a base panel according to an embodiment of the invention has a striped partition structure, the base panel including a panel member, an electrode layer formed on the panel member in a predetermined pattern, and the partition structure having unit partitions, discontinuously formed on the panel member parallel to each other, partitioning a discharge space.

According to an aspect of the invention, a dielectric layer covering the electrode layer is formed on the panel having the electrode layer.

According to another aspect of the invention, auxiliary partitions are provided at both ends of each of the unit partitions at a predetermined angle with respect to a lengthwise direction of the unit partition.

According to another embodiment of the present invention, a plasma display panel includes a first panel, address electrodes formed on the first panel in a predetermined pattern, a first dielectric layer formed on the first panel and covering the address electrodes, a partition structure having unit partitions discontinuously formed on the first dielectric layer to partition a discharge space, the unit partitions being parallel to the address electrodes and each having auxiliary partitions, red, green and blue phosphor layers coated in the partitioned discharge space, a second panel, which is coupled to and opposite the first panel to form the discharge space and which is transparent, a plurality of pairs of sustaining electrodes formed on the inner surface of the second panel and having a set of first and second electrodes at a predetermined angle with respect to the address electrodes, and a second dielectric layer formed on the second panel and covering the sustaining electrodes.

BRIEF DESCRIPTION OF THE DRAWINGS

The above and other objects and advantages of the invention will become more apparent and more readily appreciated from the following description of the preferred embodiments thereof with reference to the attached drawings in which.

DETAILED DESCRIPTION OF THE PREFERRED EMBODIMENTS

Figure 1:
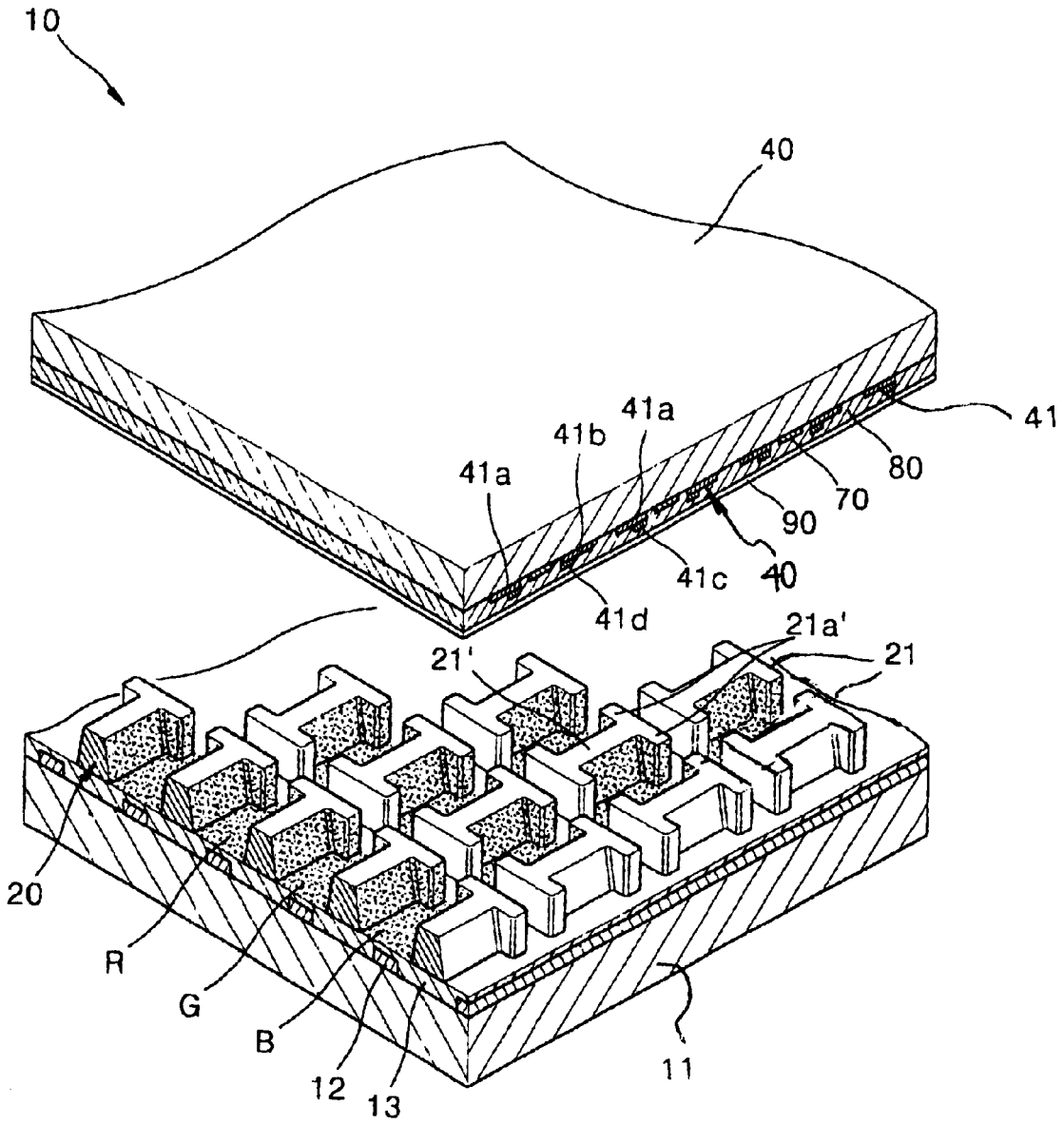
FIG. 1 is a perspective view of a plasma display device according to an embodiment of the present invention.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

FIG. 1 shows a plasma display device 10 according to an embodiment of the present invention. As shown, the plasma display device 10 includes a first panel 11, address electrodes 12 formed on the first panel 11 in a predetermined pattern, and a first dielectric layer 13, formed on the first panel 11 covering the address electrodes 12. The address electrodes 12 are formed by stripes having predetermined widths and are parallel with each other. It is understood that the pattern of the address electrodes 12 is not limited to that shown by this embodiment.

Figure 2:
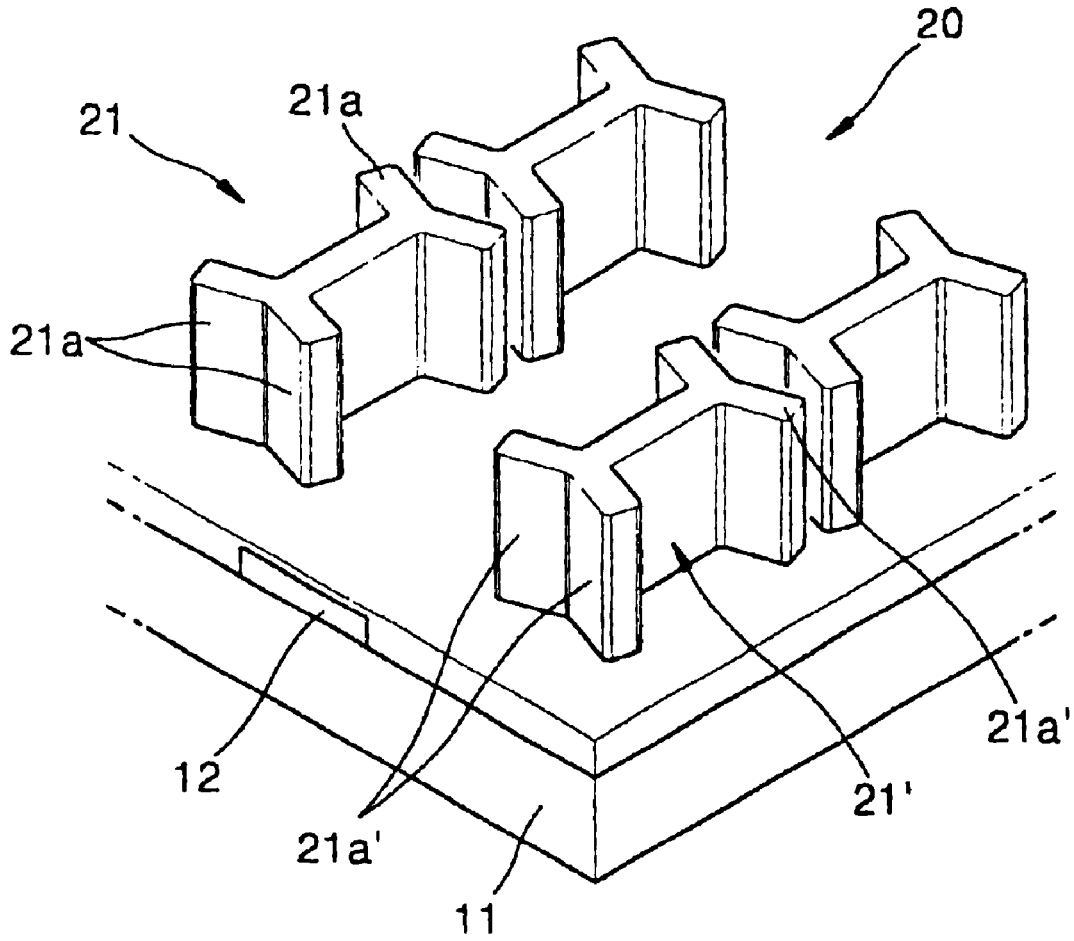
FIG. 2 is a perspective view of the partitions formed on a first panel of the plasma display panel shown in FIG. 1.

A partition structure 20, by which a discharge space is partitioned parallel to the direction of the address electrodes 12, is discontinuously formed on the first dielectric layer 13 between each of the address electrodes 12. The partition structure 20, as shown in FIGS. 1 and 2, includes a plurality of unit partitions 21 discontinuously formed parallel to the address electrodes 12. Auxiliary partitions 21a extend outward from either side of each unit partition 21 at a predetermined angle (i.e., a right angle, an acute angle, or an obtuse angle) lengthwise with respect to the unit partitions 21. The shown unit partitions 21 each have auxiliary partitions 21*a* so as to achieve a substantially "H" shape. Here, the auxiliary partitions 21*a* formed at either side of the unit partition 21 do not contact those 21*a*' of an adjacent unit partition 21'.

Figure 3:
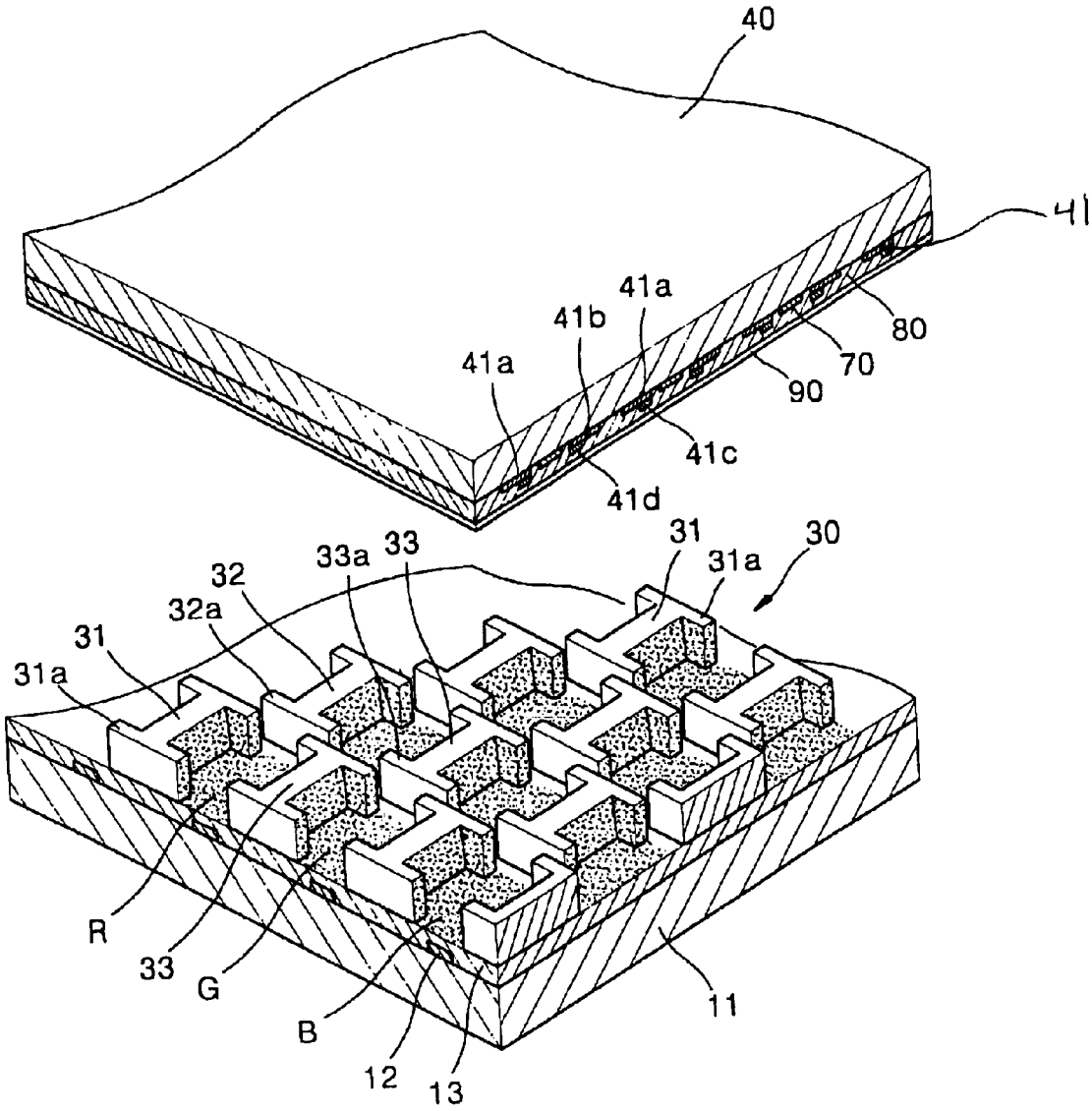
FIG. 3 shows another embodiment of the partitions formed on the first panel shown in FIG. 2.

FIG. 3 shows another embodiment of the present invention, where a partition structure 30 comprises unit partitions 31, 32 and 33. As shown, the unit partitions 32 and 33 are arranged so as to form discharge spaces at both sides of each of the unit partitions 31 which are formed lengthwise with respect to the partition structure 30. That is to say, the unit partitions 31, 32 and 33 are arranged in a delta (triangular) arrangement.

It is understood that the shapes and arrangements of the unit partitions 31, 32 and 33 forming the partition structure 30 are not limited to the embodiment described above, and can be varied in many ways. In modified examples, partitions are necessarily discontinuously structured, and auxiliary partitions 31*a*, 32*a* and 33*a* are necessarily spaced apart from one another perpendicular to the direction in which the partition structure is arranged.

As described above in relation to FIGS. 1 and 3, the first panel 11 having the partitions 20 or 30 is coupled to a second panel 40, which is transparent to shut tightly the space therebetween. A plurality of sustaining electrodes 41, which are made of a transparent, conductive material are formed on the inner surface of the second panel 40 orthogonally to the address electrodes 12. The sustaining electrodes 41 comprise pairs of first and second electrodes 41*a* and 41*b*. In order to reduce line resistance, bus electrodes 41*c* and 41*d* are formed lengthwise on the first and second electrodes 41*a* and 41*b*, respectively. The bus electrodes 41*c* and 41*d* are formed of a metal such as silver, silver alloy or aluminum, and have widths narrower than those of the first and second electrodes 41*a* and 41*b*.

The sustaining electrodes 41 formed on the second panel 40 are not limited to those in the above-described embodiment. In the embodiment of the invention shown in FIG. 4, sustaining electrodes 50 include first and second metal electrodes 51 and 52 formed of silver or silver alloy parallel to auxiliary partitions 21*a* of unit partitions 21 forming the partition structure 20. Projecting electrodes 51*a* and 52*a* extend from the first and second metal electrodes 51 and 52 over a phosphor layer and parallel to said address electrodes 12. The projecting electrodes 51*a* and 52*a* comprise a transparent, conductive material.

Figure 5:
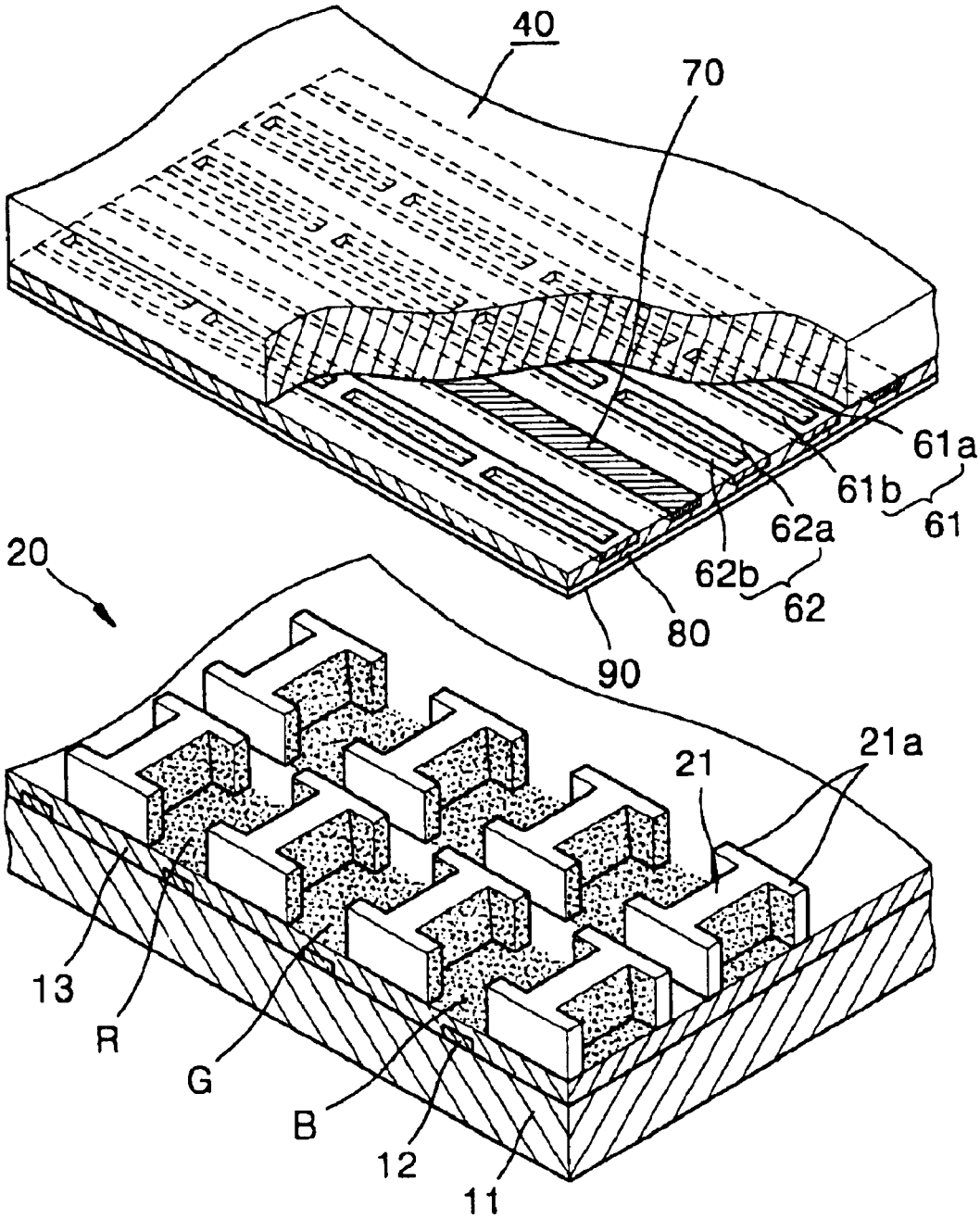

Alternatively, in the embodiment of the present invention shown in FIG. 5, sustaining electrodes 60 include first and second electrodes 61 and 62, each having a plurality of sub-metal electrodes 61*a* & 61*b* and 62*a* & 62*b*, which are both parallel and electrically connected to each other.

Figure 4:
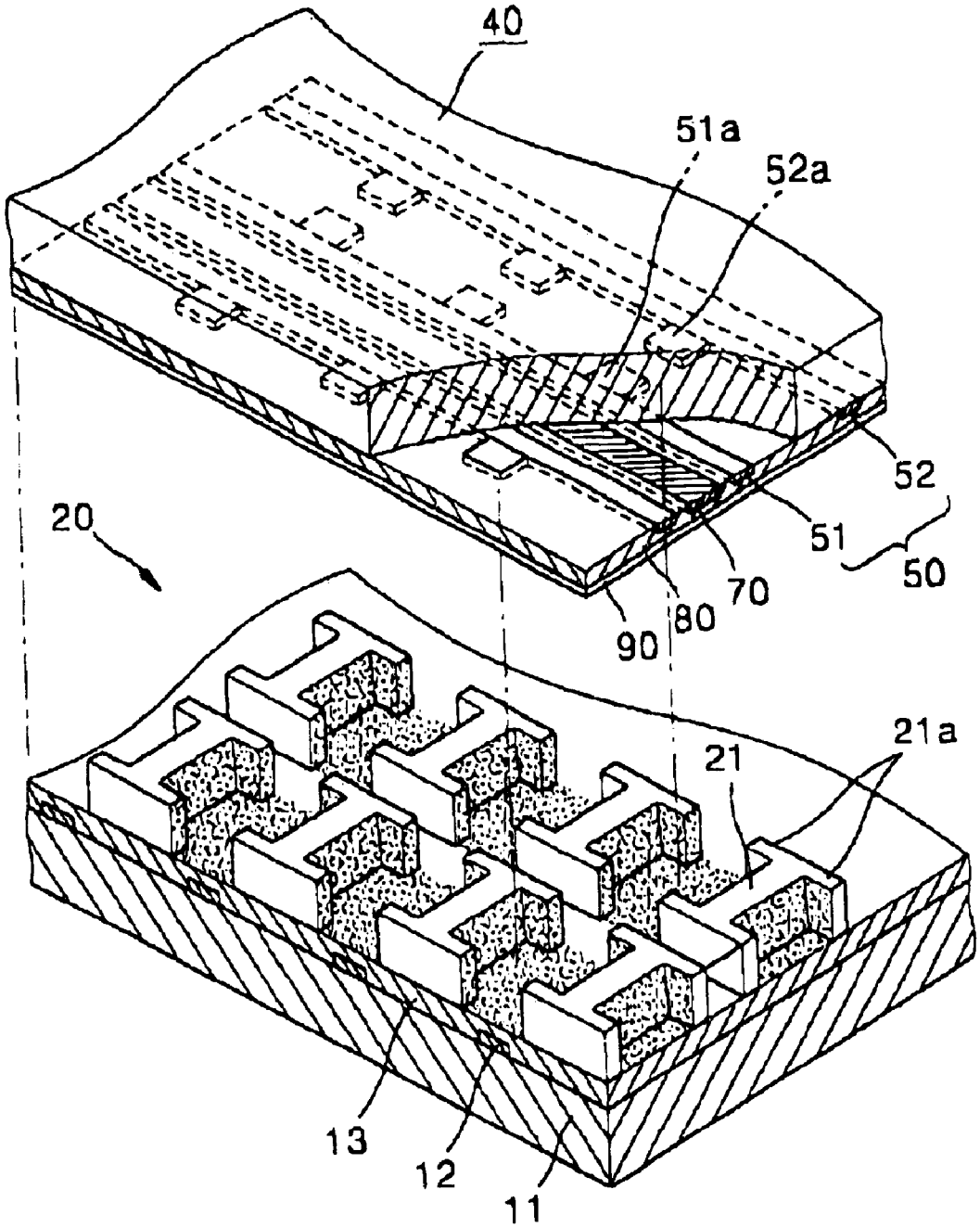
FIGS. 4 and 5 are perspective views of additional embodiments of the plasma display device according to the present invention.

As shown in FIGS. 3 through 5, a black matrix layer 70 is formed on the second panel 40 between each of the aforementioned sustaining electrodes 41, 51, 61 to be parallel to the sustaining electrodes 41, 51, 61. The black matrix layer 70 is preferably formed over the discontinuous portions of the unit partitions 21 (i.e., the portions corresponding to the disconnected portions of the unit partitions 21).

Referring back to FIG. 1, a second dielectric layer 80 is formed on the panel 40 having the sustaining electrodes 41 and the black matrix layer 70, covering the sustaining electrodes 41 and the black matrix layer 70. A protective layer 90, made of MgO, is formed on the second dielectric layer 80.

Red (R), green (G) and blue (B) phosphor layers are formed on the inner surface of the spaces partitioned by the unit partitions 21. The R, G and B phosphor layers may be parallel to the length direction of the partition structure 20 having unit partitions 21, or may be disposed in a delta arrangement, as shown in FIG. 3.

The aforementioned plasma display devices according to the present invention operate as follows.

First, if a predetermined pulse is applied to the address electrode 12 and one of the first and second electrodes 41*a* and 41*b* of the sustaining electrode 41, an address discharge occurs therebetween to generate wall charges on the inner surface of the discharge space. The surface of the dielectric layer 80 between the first and second electrodes 41*a* and 41*b* is covered with the generated wall charges.

Then, if a voltage is applied to the first and second electrodes 41*a* and 41*b* which comprise the sustaining electrode 41, a sustaining discharge occurs there between to generate parent beams. The voltage for initiating the sustaining discharge can be reduced by the charges filled between the partitions.

The phosphor layers coated over the discharge space are excited by the parent beams generated by the selected sustaining discharge to emit light. During this procedure, the phosphor layers excited by the parent beams are formed on the inner surface of the discharge space partitioned by the main part of the unit partition 21 and the auxiliary partitions 21*a* formed at either ends. As such, the phosphor layers are coated on a relatively wider area, thereby improving the luminance. Also, since the discharge cells are partitioned by the auxiliary partitions 21*a*, crosstalk between pixels can be prevented.

Since the plasma display device according to the present invention has the discontinuously formed partition structure 20 and the auxiliary partitions 21*a* not in contact with adjacent auxiliary partitions 21*a*', gas exhaustion can be easily performed. Also, since gas exhaustion or injection takes place in every direction along the spaces produced between the disconnected unit partitions 21 and 21', the gas exhausting efficiency and discharge gas injection efficiency can be improved.

Also, as shown in FIG. 3, in the plasma display device having unit partitions disposed in a delta arrangement, the delta arrangement of the R, G and B phosphors is more advantageous in achieving a clear display.

As described above, according to the plasma display device of the present invention, phosphors are coated on the bottom surface of a discharge space and the sidewalls of unit partitions and auxiliary partitions, thereby increasing the area where the phosphor layers are formed and improving the luminance. Also, since the partition structure having unit partitions allows gas exhaustion to take place in every direction along the discharge space, the gas exhausting efficiency can be improved.

While a few preferred embodiments of the present invention have been shown and described, it would be appreciated by those skilled in the art that various other embodiments, modifications and adaptations of the invention may be made in these embodiments without departing from the principles and spirit of the invention, the scope of which is defined in the claims and their equivalents.

What is claimed is:

1. A base panel for use in a plasma display device, comprising:

a first panel including address electrodes formed on said first panel in a predetermined pattern:

a second panel coupled to said first panel to form a discharge space between said first panel and said second panel, and a partition structure comprising unit partitions, wherein the unit partitions are discontinuously formed on said first panel to partition the discharge space, the unit partitions being parallel to the address electrodes and each of the unit partitions having auxiliary partitions extending from both ends of each unit partition, wherein the unit partitions are disposed in a delta arrangement.

2. A plasma display device having a base panel having a partition structure, comprising:

a first panel;

address electrodes formed on said first panel in a predetermined pattern;

a first dielectric layer formed on said first panel and covering said address electrodes;

a partition structure comprising unit partitions discontinuously formed on said first dielectric layer to partition a discharge space, the unit partitions being parallel to said address electrodes and each of the unit partitions having auxiliary partitions extending from both ends of each unit partition;

red, green and blue phosphor layers coated in the partitioned discharge space:

a second panel, which is coupled to said first panel to form the discharge space between said first and second panels, said second panel being transparent;

sustaining electrodes formed on an inner surface of said second panel and comprising pairs of first and second electrodes disposed at a predetermined angle with respect to the address electrodes; and a second dielectric layer formed on said second panel and covering said sustaining electrodes, wherein the unit partitions are disposed in a delta arrangement.

3. A base panel for use in a plasma display device, comprising:

a panel member;

electrodes formed on said panel member in a predetermined pattern;

a dielectric layer formed over said panel member and covering said electrodes; and unit partitions formed on said dielectric layer, pluralities of said unit partitions being disposed in rows across said electrodes, wherein adjacent pairs of said unit partitions in a common row define a unit discharge space extending across a corresponding one of said electrodes, and adjacent ones of said unit partitions do not contact each other.

4. The base panel of claim 3, wherein each of said unit partitions further comprises an end from which an auxiliary partition extends toward the corresponding one of said electrodes.

5. The base panel of claim 4, wherein each of said unit partitions further comprises an additional end, wherein an additional auxiliary partition extends towards the corresponding one of said electrodes.

6. The base panel of claim 3, wherein each of said unit partitions further comprises auxiliary partitions extending from ends of each of said unit partitions towards corresponding ones of said electrodes.

7. The base panel of claim 3, wherein centers of the unit discharge spaces of adjacent rows follow a respective one of said electrodes.

8. The base panel of claim 3, wherein centers of the unit discharge spaces of adjacent rows are at an angle to a respective one of said electrodes.

9. The base panel of claim 6, wherein the auxiliary partitions of each of said unit partitions extend away from said unit partition at an equal angle.

10. The base panel of claim 6, wherein the auxiliary partitions of each of said unit partitions are disposed as to define an H shape.

11. The base panel of claim 6, wherein the auxiliary partitions of each of said unit partitions extend symmetrically away from said unit partition as to define V shapes from the respective ends.

12. The base panel of claim 3, further comprising phosphor layers, each of said phosphor layers being disposed in a respective one of the unit discharge spaces.

13. The base panel of claim 12, wherein said phosphor layers are disposed on said dielectric layer and on opposing side of said unit partitions within the respective unit discharge spaces, but are not disposed between rows of said unit partitions.

14. A plasma display device, comprising:

a base panel;

base electrodes on said base panel in a predetermined pattern;

a base dielectric layer on said base panel and covering said base electrodes;

unit partitions formed on said base dielectric layer, pluralities of said unit partitions being disposed in rows across said base electrodes, wherein adjacent pairs of said unit partitions in a common row define a unit discharge space across a corresponding one of said base electrodes, and adjacent ones of said unit partitions do not contact each other;

phosphor layers, each phosphor layer being disposed in a corresponding one of the unit discharge spaces;

a front panel opposite to and connected to said base panel;

front electrodes on an inner surface of said front panel at a predetermined angle with respect to said base electrodes; and a front dielectric layer on said front panel and covering said front electrodes.

15. The plasma display panel of claim 14, wherein each of said unit partitions further comprises auxiliary partitions extending from ends of each of said unit partitions toward corresponding ones of said base electrodes.

16. The plasma display panel of claim 15, wherein said phosphor layers are not disposed outside the unit discharge spaces.

17. The plasma display panel of claim 16, further comprising a black matrix layer on said front panel and covered by said front dielectric layer, said black matrix layer being disposed between adjacent front electrodes so as to not be over one of said phosphor layers.

18. The plasma display panel of claim 17, wherein said phosphor layers are not disposed between adjacent rows of said unit partitions.

19. The plasma display panel of claim 14, wherein pluralities of said unit partitions of adjacent rows are disposed diagonally as to form deltas.

20. The plasma display device of claim 14, wherein each of said front electrodes further comprise projecting electrodes disposed parallel with said base electrodes.

21. The plasma display device of claim 14, wherein each of said front electrodes further comprise sub electrodes disposed parallel to and connected to each other.

* * * * *